US006202229B1

(12) United States Patent
Cheng

(10) Patent No.: US 6,202,229 B1
(45) Date of Patent: Mar. 20, 2001

(54) JOINT OF A FOLDABLE BED FOR BABIES

(75) Inventor: Ying-Hsiung Cheng, Tainan Hsien (TW)

(73) Assignee: Pao-Hsien Cheng, Tainan Hsien (TW)

( * ) Notice: Subject to any disclaimer, the term of this patent is extended or adjusted under 35 U.S.C. 154(b) by 0 days.

(21) Appl. No.: 09/343,182

(22) Filed: Jun. 30, 1999

(51) Int. Cl.[7] ..... A47D 7/00

(52) U.S. Cl. ..... 5/99.1; 5/98.1; 403/100; 403/102

(58) Field of Search ..... 5/99.1, 93.1, 98.1, 5/102; 403/100, 102, 325

(56) References Cited

U.S. PATENT DOCUMENTS 5,293,656 * 3/1994 Chan ..... 5/99.1
5,611,634 * 3/1997 Wang ..... 5/99.1 X
5,730,542 * 3/1998 Cheng ..... 5/99.1 X
5,745,954 * 5/1998 Shogan et al. ..... 403/102 X

* cited by examiner

*Primary Examiner*—Terry Lee Melius
*Assistant Examiner*—Fredrick Conley
(74) *Attorney, Agent, or Firm*—Rosenberg, Klein & Lee

(57) ABSTRACT

A joint of a foldable bed for babies comprises a main body, a pressing block and two supporting members. The main body has two side plates connected by an intermediate curved portion. The pressing block is slidably fitted in the main body. The supporting members are pivotted to the main body, and each separably engage a respective side trench of the pressing block to be located at a first position. The pressing block is biased downwards by a spring. Two supporting rods of the frame of the folable bed are pivotted to the main body. The supporting rods have inner ends contact and engage the supporting members when same are located at the first position. To fold the bed, the pressing block is pressed upwards to disengage same from the supporting members, the supporting members being pivotted on the main body. Thus, the supporting rods of the frame can be pivotted on the main body to fold the bed.

1 Claim, 9 Drawing Sheets

JOINT OF A FOLDABLE BED FOR BABIES

BACKGROUND OF THE INVENTION

The present invention relates to a joint of a foldable bed for babies. The bed can be folded to a smaller size for storage when not in use; the bed is foldable at the joint.

Referring to FIGS. 8 and 9, a heretofore known joint of a foldable bed comprises a main body 10, auxiliary parts 20, a pressing part 30 and two confining plates 40 as the main parts.

The main body 10 has two side plates 101 and an intermediate portion 104. The side plates 101 each has an upper and a lower locating holes 102 and 103. The intermediate portion 104 has an engaging hole 105 having engaging edges 106 protruding downwards therefrom. A spring 107 is connected to the engaging edges 106.

The auxiliary parts 20 each has holes 201 and a locating hole 203. Supporting rods of the foldable bed is coupled to the auxiliary parts 20 with locating pins 202 inserted into the supporting rods and the holes 201. The locating pin 202, as shown in FIG. 9, are also inserted through the upper locating holes 102 of the main body 10 such that the supporting rods and the auxiliary parts 20 can pivot on the main body 10. The locating holes 203 of the auxiliary parts 20 are each connected with a locating pin 204.

The pressing part 30 has two guide channels 301, two recesses 302, a through hole 303 and a holding hole 304.

The confining plates 40 each has curved guide portions 401, hooked portions 402 and a hole 403. The confining plates 40 are held by the recesses 302 of the pressing part 30; a fixing pin 404 is inserted into the holes 403 and 303 to fix the confining plates 40 to the pressing part 30.

The pressing part 30 is movable fitted to the main body 10 with locating pins 108 passed through the guide channels 301, and the lower locating holes 103. The holding hole 304 holds a lower end of the spring 107 when the pressing part 30 is fitted to the main body 10.

Furthermore, each of the locating holes 203 of the auxiliary parts 20 has a locating pin 204 inserted therein.

Whereby, the auxiliary parts 20 can pivot on the main body 10 for the bed to be folded when the pressing part 30 is pressed upwards to disengage the locating pins 204 from the hooked portions 402 of the confining plates 40.

However, it is found that the joint of the foldable bed has undesirable features as follows.

1. Comprising one main body, two auxiliary parts, one pressing part, two confining plates and several locating pins, the joint has too many parts. So, the assembly process is relatively complicated.
2. In assemblying, the supporting rods have to be coupled to the auxiliary parts, and the confining plates have to be coupled to the pressing parts before same are fitted to the main body, costing relatively much time and labor.

SUMMARY

It is a main object of the present invention to provide a joint for a foldable bed which has relatively uncomplicated structure, and can be assembled easily.

The joint comprises:

a main body having two sides plates and an intermediate curved portion connecting the side plates the intermediate portion having two downwardly extending stopping plates;

a pressing block slidably fitted to the main body between the side plates; the pressing block having a round hole on a top receiving a spring for biasing the pressing block downwards, the pressing block having two engaging trenches on two sides thereof;

two supporting members respectively have a curved portion, an elastic plate, and an engaging protrusion; the supporting members being pivotted to the main body with the elastic plates located between the stopping plates of the main body, the engaging protrusions being capable of engaging a respective one of the engaging trenches for locating the supporting members at a first position; two supporting rods of the foldable bed being pivotted to the main body with inner ends contacting a respective curved portions of the supporting members when the supporting members are located at the first position;

the pressing block being pressed upwards to disengage the engaging trenches from the engaging protrusions for the supporting members to become pivotable on the main body;

Whereby the inner ends of the supporting rods can move away from the curved portions and the supporting rods can pivot on the main body for the bed to be folded.

The joint of a foldable bed of the present invention has only four main components, i.e. the main body, the supporting members and the pressing block, so it can be assembled relatively easily.

BRIEF DESCRIPTION OF THE DRAWINGS

The present invention will be better understood by reference to the accompanying drawings, wherein.

DETAILED DESCRIPTION OF THE PREFERRED EMBODIMENTS

Figure 1:
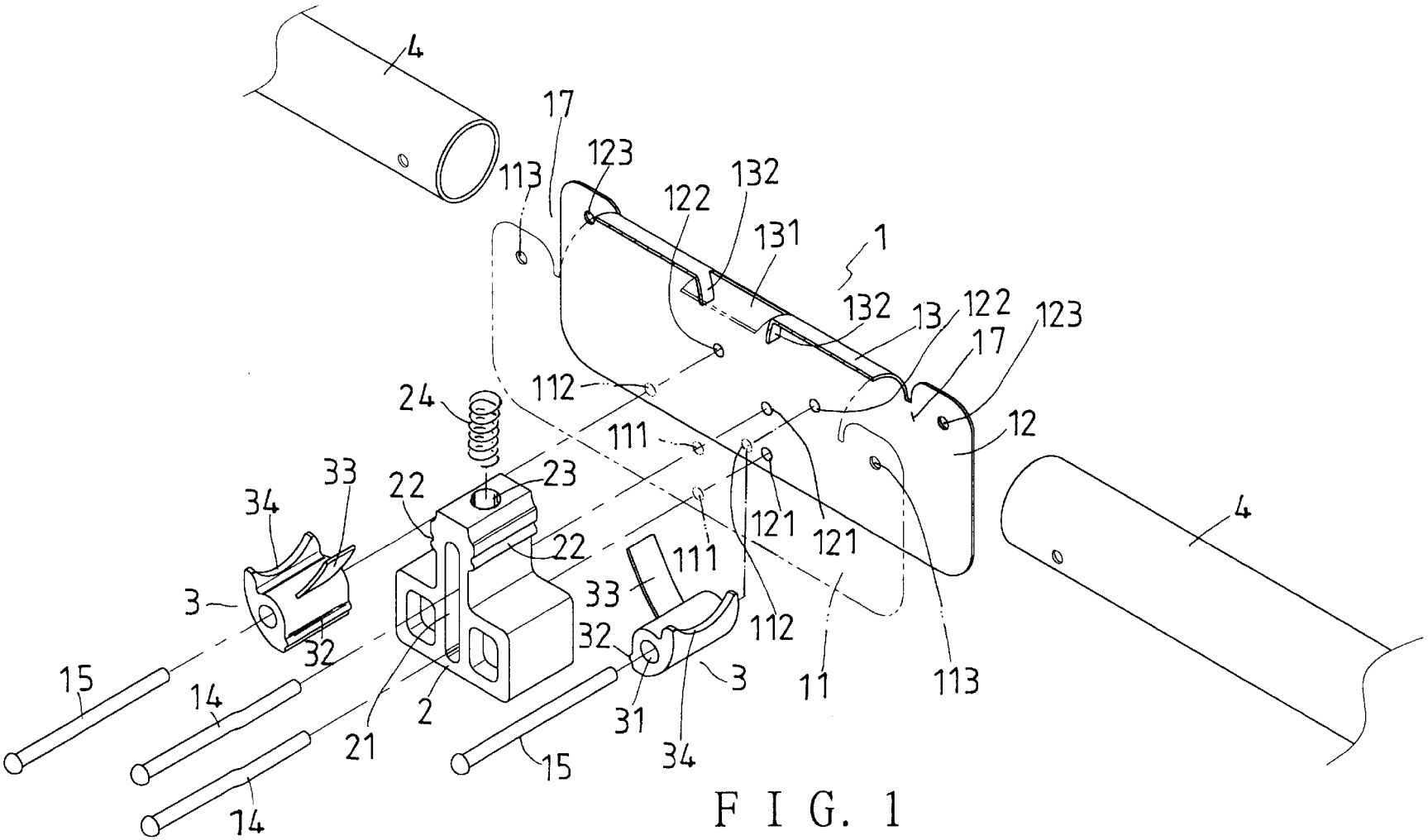
FIG. 1 is an exploded perspective view of a joint of a foldable bed for babies of the present invention.

Referring to FIG. 1, a joint of a foldable bed of the present invention has a main body 1, a pressing block 2 and two supporting members 3 as the main parts.

The main body 1 has two side plates 11, 12 and a curved intermediate portion 13. The side plates 11, 12 each has two locating holes 111, 121 and two connecting holes 112, 122. The connecting holes 112 are arranged at two sides of the upper one of the locating hole 111. In FIG. 1, the connecting holes 112 are higher than the locating holes 111. The connecting holes 122 are also arranged on two sides of the upper one of the locating hole 121 at a higher position than same.

The intermediate portion 13 has two stopping plates 132 extending downwards.

The side plates 11, 12 each further has pivotal holes 113, 123.

The pressing block 2 has an elongated hole 21, two engaging trenches 22 and a round hole 23. A spring 24 is mounted on the round hole 23 at a lower end thereof.

The supporting members 3 each has a through hole 31, an engaging protrusion 32, an elastic plate 33 and a curved portion 34.

In combination, the pressing block 2 is movably received within the main body 1 with two locating rivets passed through the elongated hole 21 of the block 2, and the locating holes 111, 121 of the main body 1. The spring 24 is positioned between the stopping plates 132 under the intermediate portion 13 such that the pressing block 2 is biased upwards by the same.

The supporting members 3 are each pivotted to the connecting holes 112, 122 of the main body 1 by a connecting pin 15; the connecting pin 15 is passed through the through hole 31 of the supporting member 3, and the connecting holes 112, 122. The engaging protrusions 32 of the supporting members 3 will each disengagably engage a respective one of the engaging trenches 22 of the pressing block 2 to locate the supporting members 3 at a first position. And, the elastic plates 33 of the supporting members 3 will be located between the stopping plates 132 of the main body 1.

Figure 2:
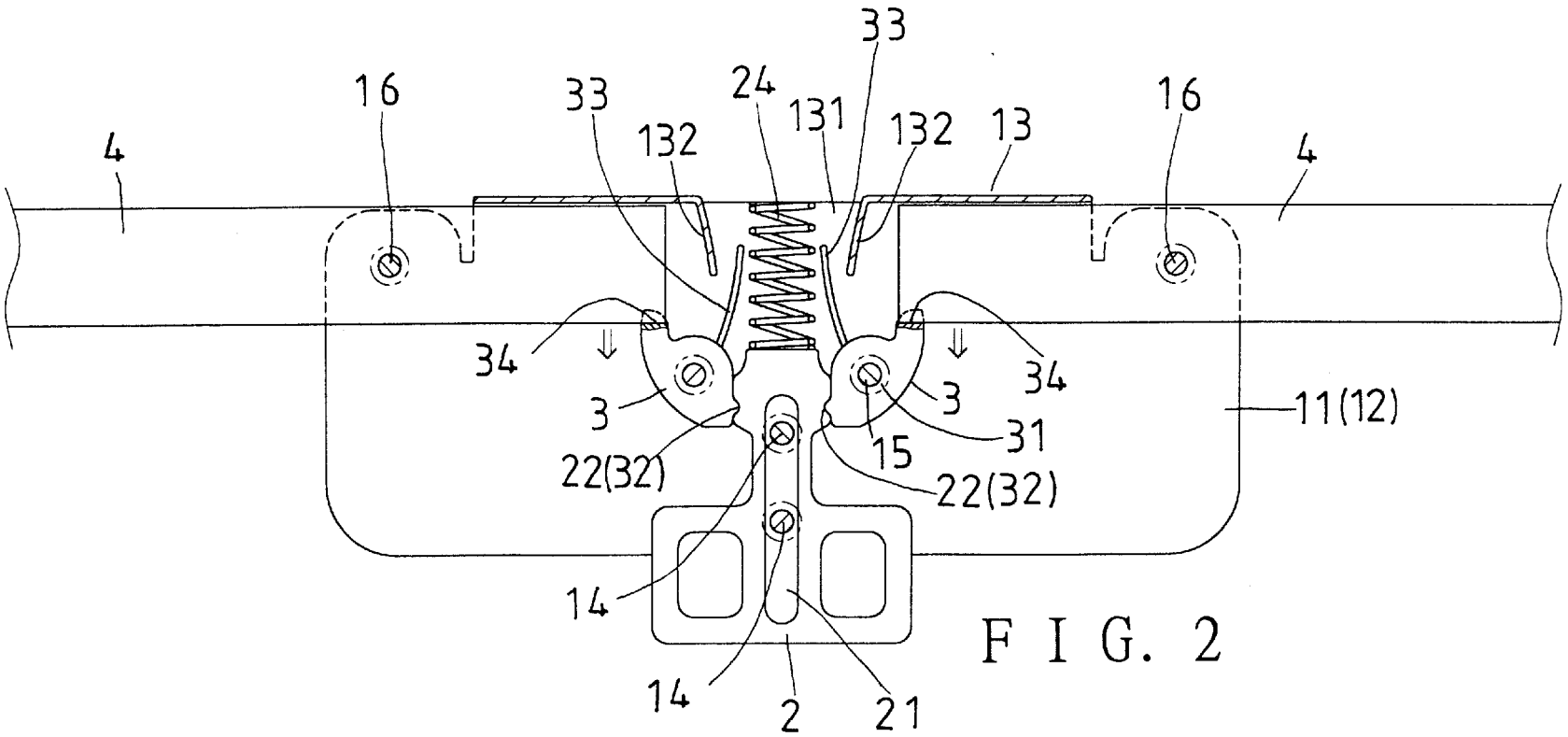
FIG. 2 is a cross-sectional view of the joint of a foldable bed for babies of the present invention.

The main body 1 is further connected to two supporting rods 4 of the frame of the foldable bed by using pivotting pins 16 on the pivotal holes 113, 123, as shown in FIG. 2. Thus, the supporting rods 4 can pivot on the main body 1. The supporting rods 4 will each contact and depress a respective one of the curved portions 34 of the supporting members 3 at inner ends thereof due to gravity when the supporting members 3 are located at the first position.

Figure 3:
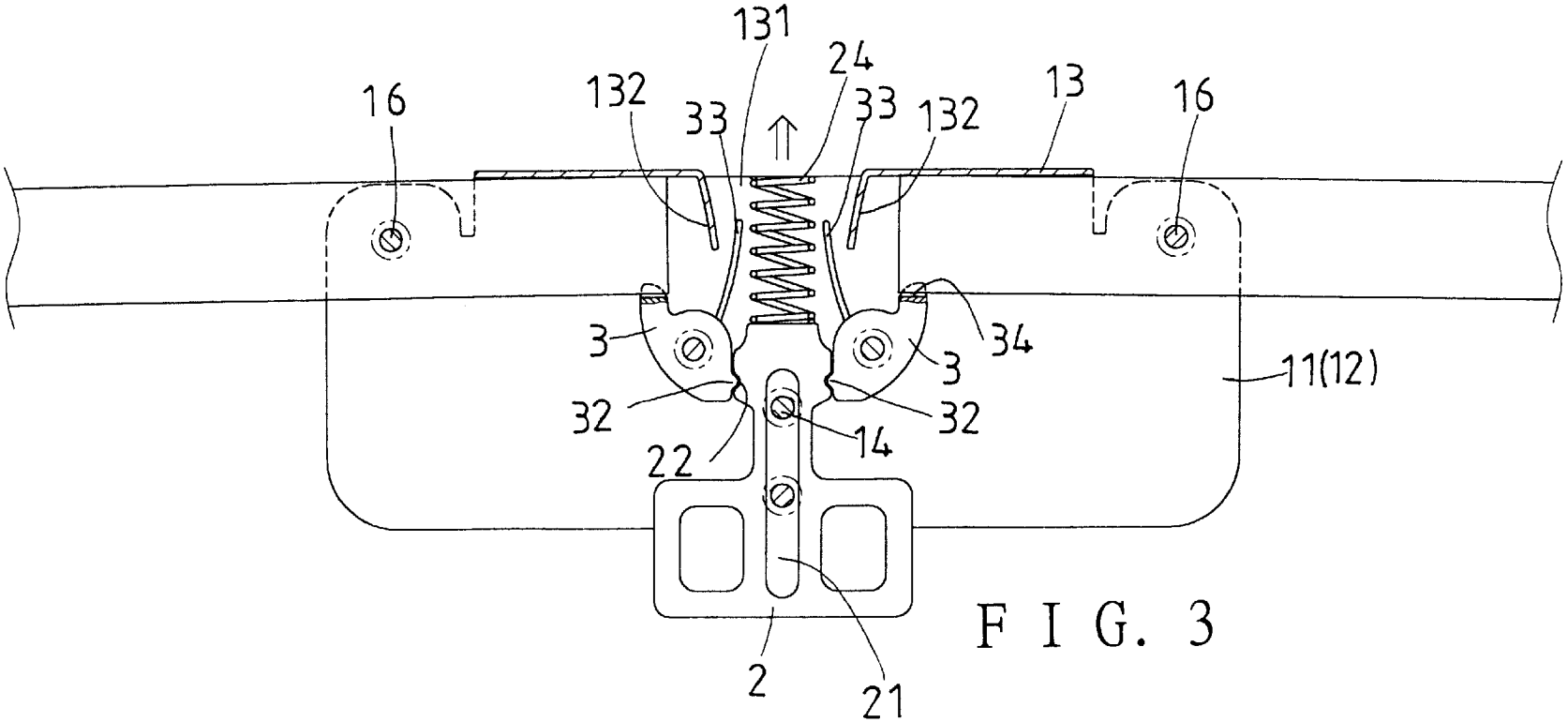
FIG. 3 is a view of the joint of a foldable bed for babies of the present invention, showing a first step of the folding process thereof.
Figure 4:
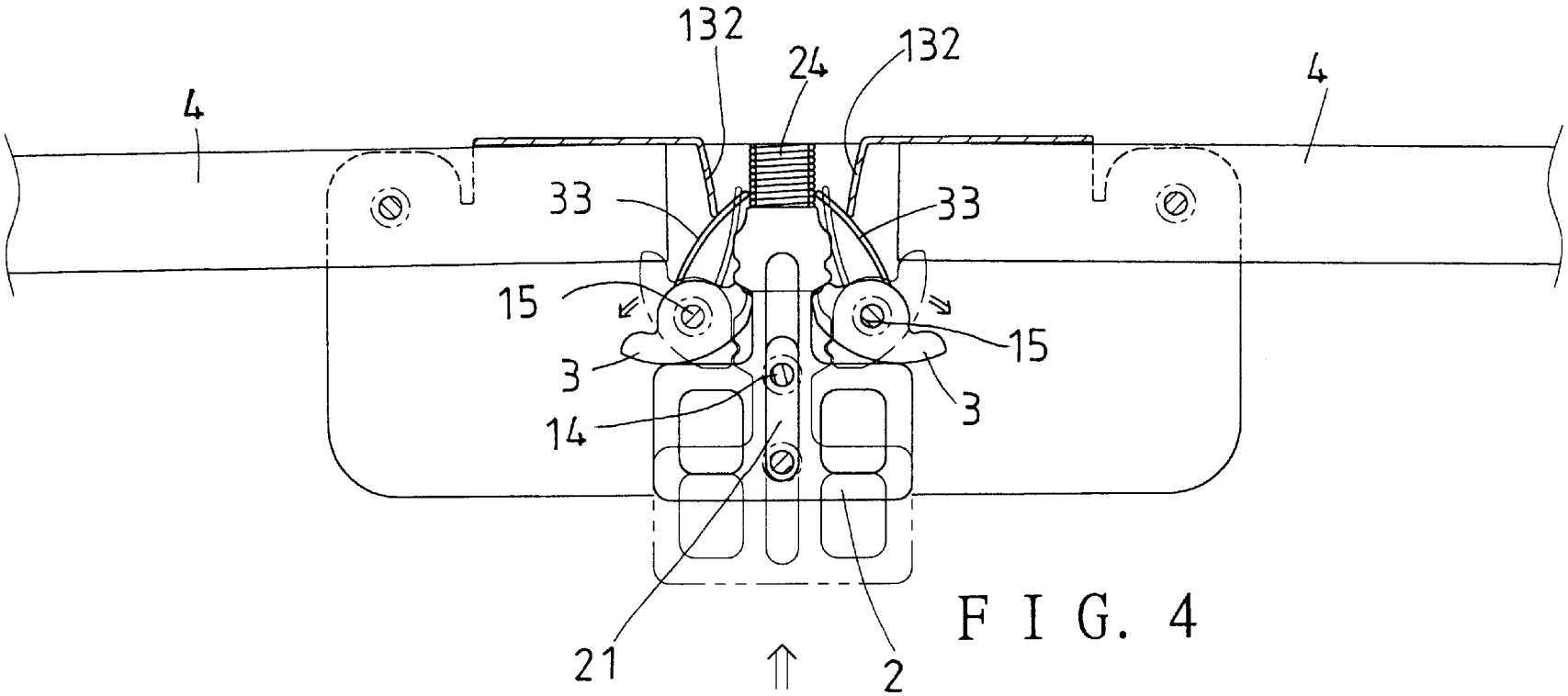
FIG. 4 is a view of the joint of a foldable bed for babies of the present invention, showing a second step of the folding process thereof.
Figure 5:
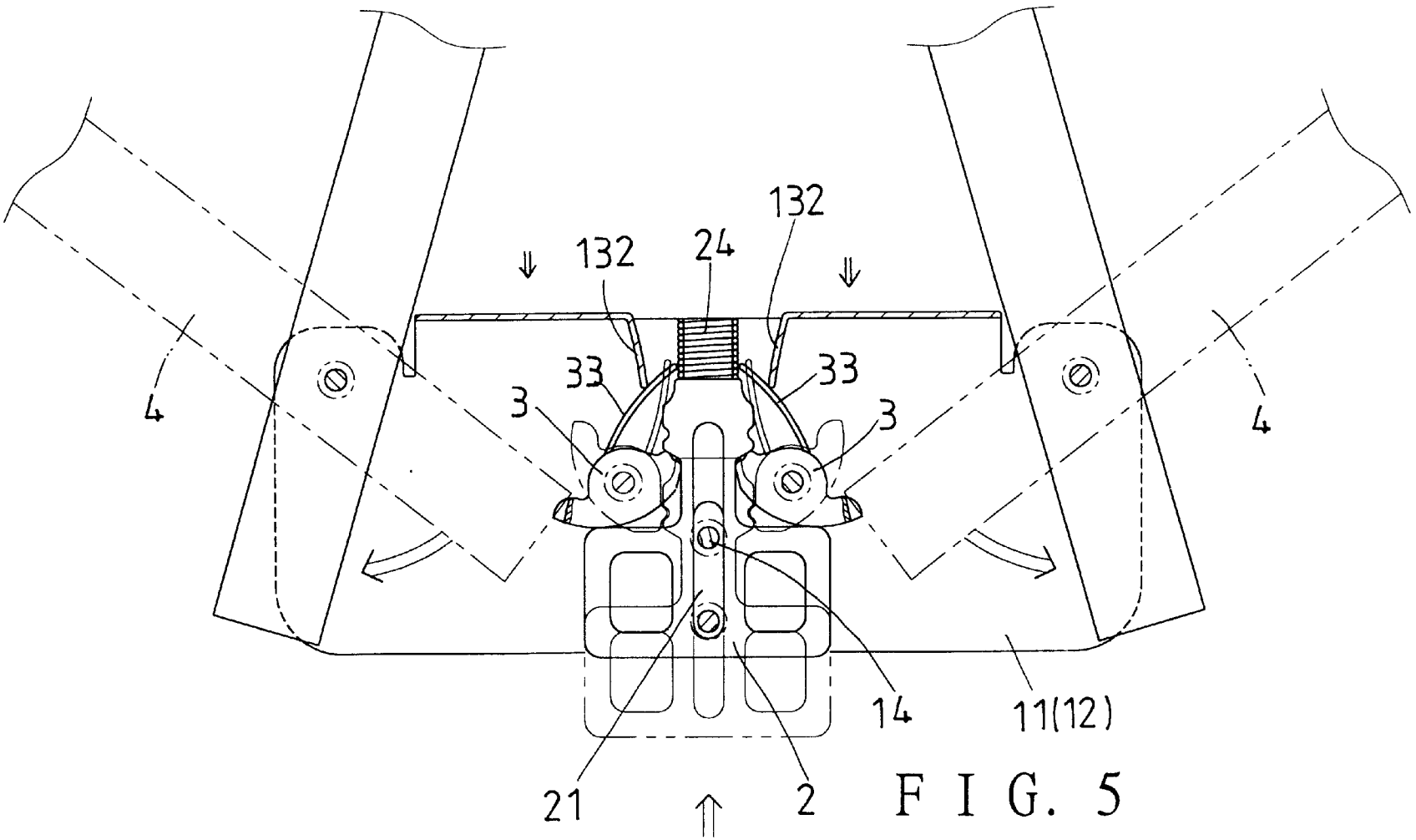
FIG. 5 is a view of the joint of a foldable bed for babies of the present invention, showing a third step of the folding process thereof.

To fold the bed, the joint is lifted upwards, as shown in FIG. 3, for the inner ends of the supporting rods 4 to move away from the curved portions 34 of the supporting members 3. Thus, the pressing block 2 can be pressed upwards. Referring to FIG. 4, when the pressing block 2 is pressed upwards, the supporting members 3 are pivotted, and finally the engaging protrusions 32 will be disengaged from the engaging trenches 22 of the pressing block 2. The elastic plates 33 are stopped by the stopping plates 132 of the main body 1 to confine the pivotal movement of the supporting members 3. Thus, the joint can be depressed for the supporting rods 4 of the foldable bed to be pivotted on the main body 1 as shown in FIG. 5.

Figure 6:
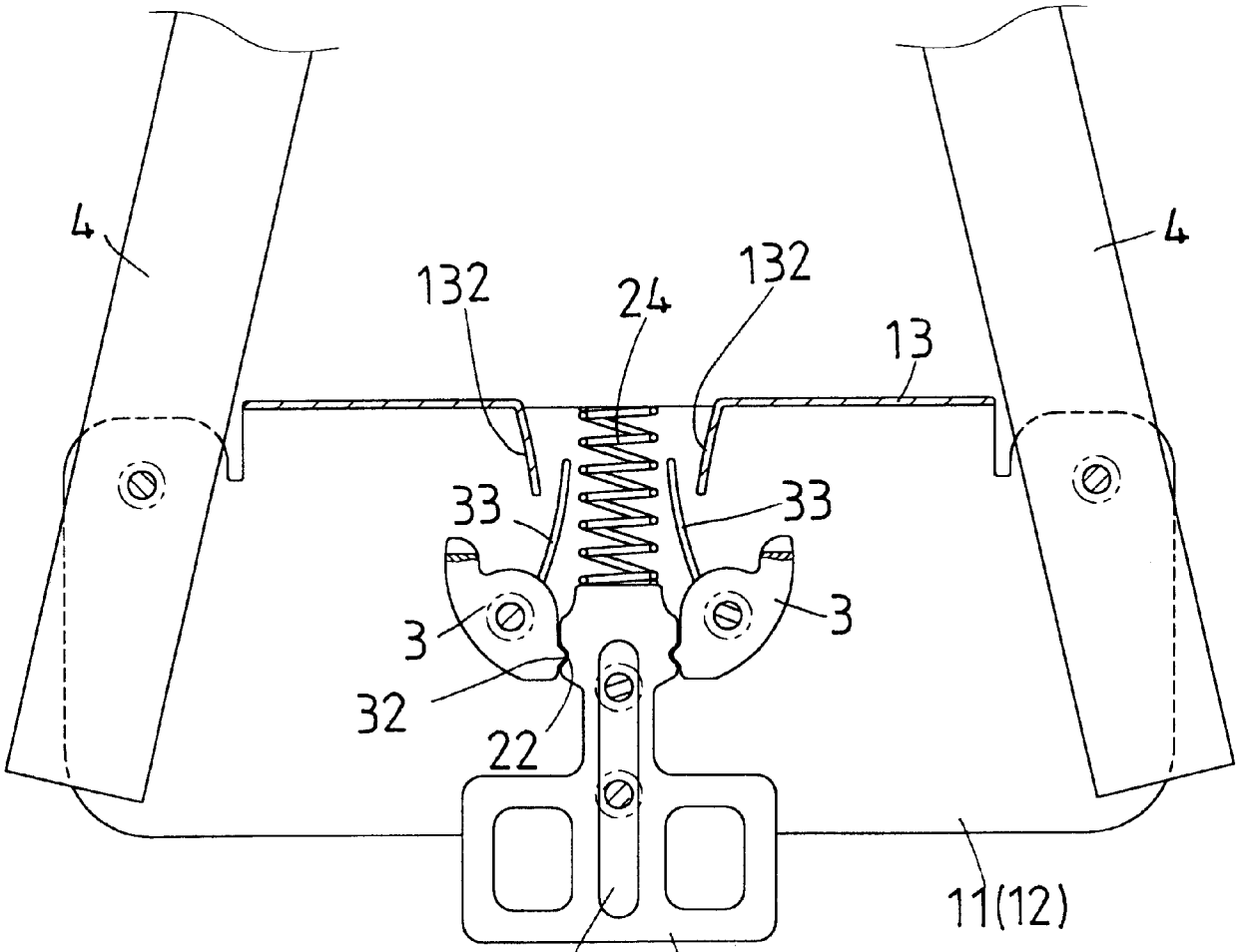
FIG. 6 is a view of the joint of a foldable bed for babies of the present invention, which is in a completely folded position.
Figure 7:
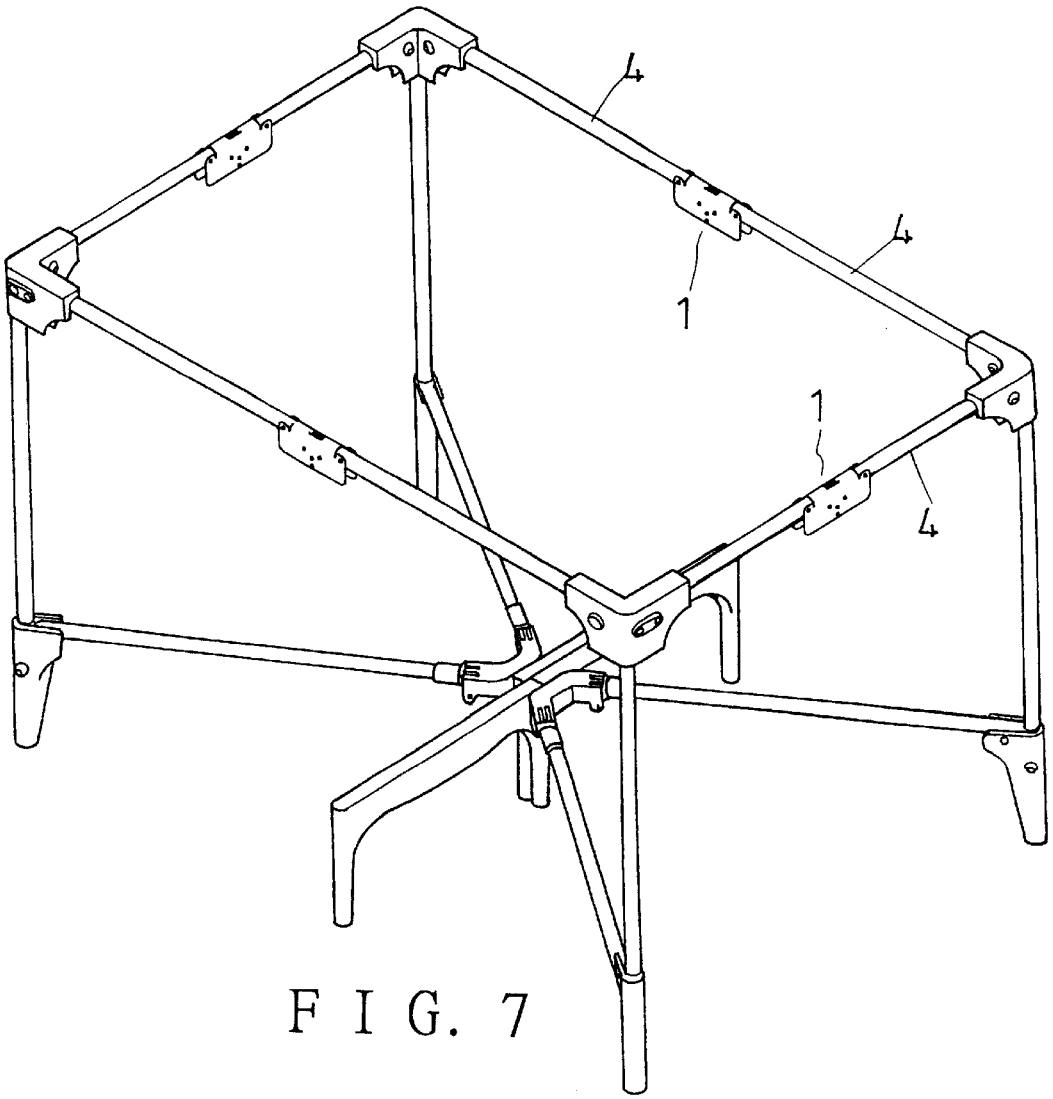
FIG. 7 is a view of a foldable bed with the joints of the present invention fitted thereto.
Figure 8:
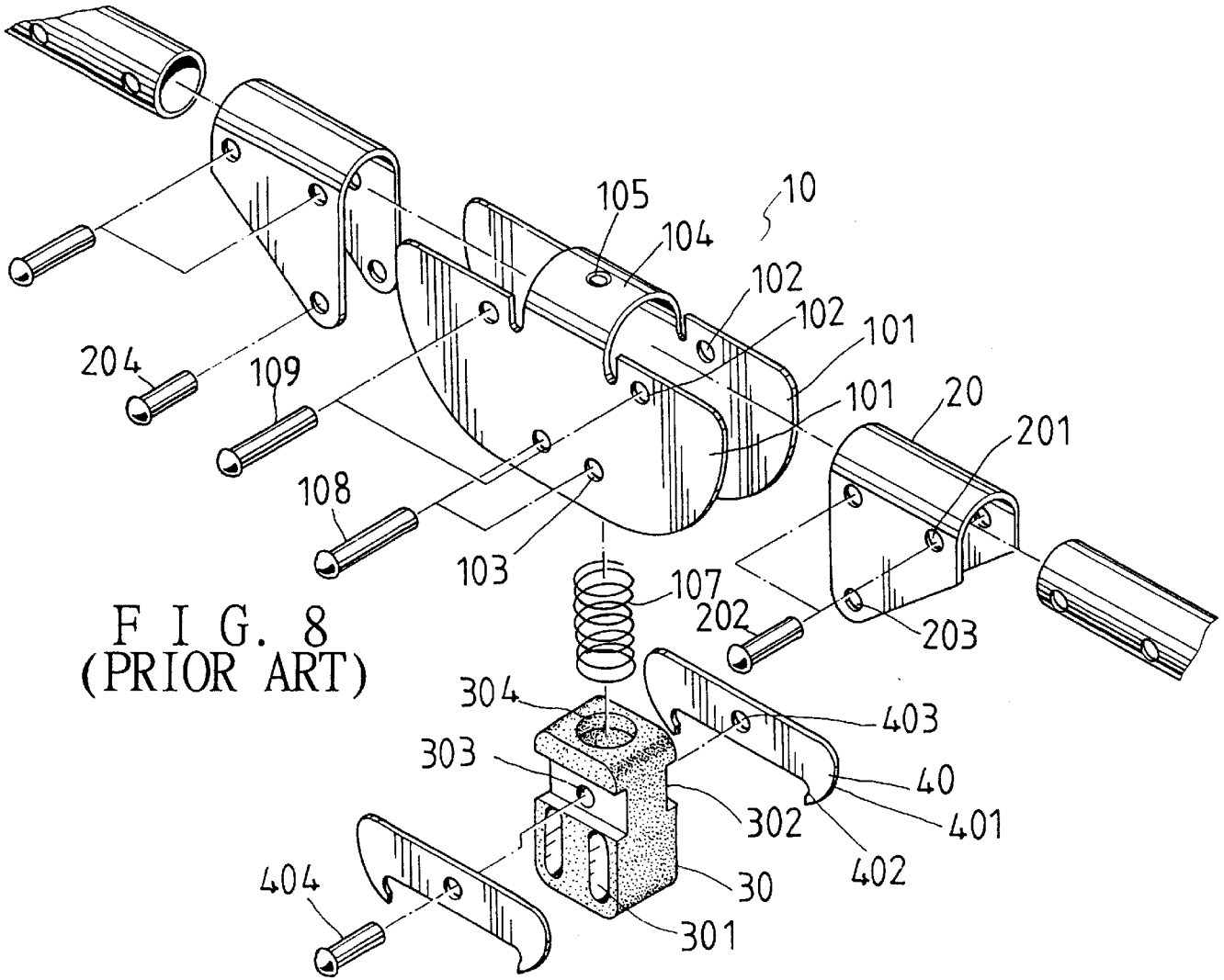
FIG. 8 (PRIOR ART)
FIG. 8 is an exploded perspective view of a prior art joint of a foldable bed for babies according to the Background.
Figure 9:
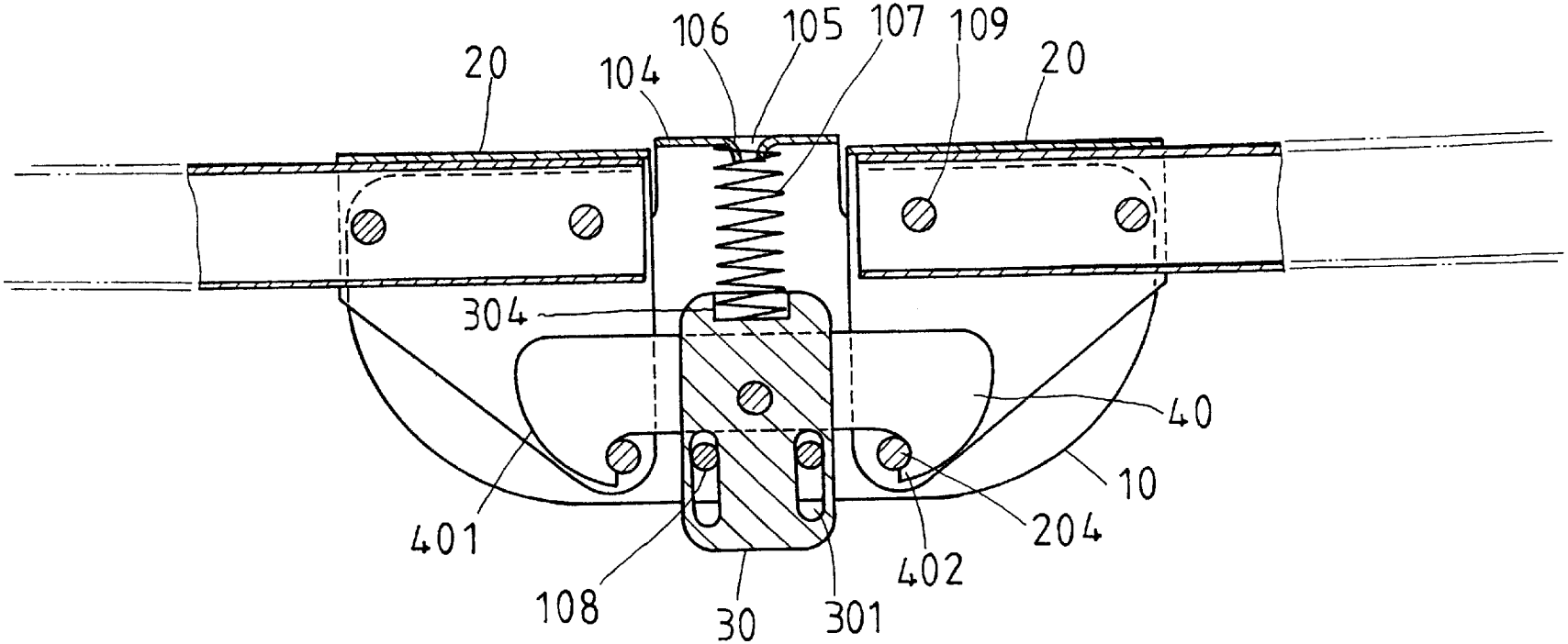
FIG. 9 (PRIOR ART)
FIG. 9 is a cross-sectional view the prior art joint of a foldable bed for babies.

When the pressing block 2 is released, it will be biased downwards by the spring 24 to move to the original position as shown in FIG. 6.

To stretch the folded bed, the joint is lifted upwards for the inner ends of the supporting rods 4 to move over the supporting members 3, and rest on the curved portions 34 of the supporting members 3.

When the inner ends of the supporting rods 4 press the curved portions 34 of the supporting members 3 due to gravity, the engaging protrusions 32 will engage the engaging trenches 22 firmly, and cannot separate from the same, preventing the bed from being unwantingly folded in case the pressing block 2 is pressed accidentally.

From the above description, it can be understood that the joint of a foldable bed of the present invention has desirable features as follows.

1. Comprising a main body, a pressing block, two supporting members and a few pins, the joint of the present invention has fewer parts than the prior art one in the Background.
2. The assemblying is much easier because the supporting rods and the supporting members are directly fitted to the main body by locating pins, etc.
3. The assemblying process cost much less time and labor.

What is claimed is:

1. A joint of a foldable bed for babies comprising (a) a main body having two side plates connected by an intermediate curved portion thereof, said intermediate portion having two downwardly extending stopping plates;

(b) a pressing block fitted to said main body between said two side plates, said pressing block being capable of sliding upwards and downwards in said main body, said pressing block having a round hole on a top portion receiving a spring for biasing said pressing block downwards, said pressing block having two engaging trenches on two sides thereof;

(c) two supporting members each having a curved portion, an elastic plate and an engaging protrusion, said supporting members being pivotted to said main body with said elastic plates located between said stopping plates of said main body, said engaging protrusions being capable of engaging a respective one of said engaging trenches for said supporting members to be located in a first position, two supporting rods of said foldable bed being pivotted to said main body with inner ends thereof contacting a respective one of said curved portions of said supporting members when said supporting members are located at said first position, said pressing block being pressed upwards to disengage said engaging trenches from said engaging protrusions of said supporting members for said supporting members to be pivotable on said main body, said stopping plates confining said pivotal movement of said supporting members by stopping said elastic plates of said supporting members; whereby said inner ends of said supporting rods can move away from said curved portions, and said bed to be folded.

* * * * *